US005806671A

United States Patent [19]

Focke et al.

[11] Patent Number: 5,806,671

[45] Date of Patent: Sep. 15, 1998

[54] HINGE-LID PACK, ESPECIALLY FOR CIGARETTES

[75] Inventors: Heinz Focke, Verden; Henry Buse, Visselhövede, both of Germany; Dieter Neuber, Upper Saddle River, N.Y.

[73] Assignee: Focke & Co. (GmbH & Co.), Verden, Germany

[21] Appl. No.: 827,373

[22] Filed: Mar. 27, 1997

[30] Foreign Application Priority Data

Apr. 10, 1996 [DE] Germany ..... 196 14 043.9

[51] Int. Cl.[6] ..... B65D 85/10

[52] U.S. Cl. ..... 206/268; 229/160.1

[58] Field of Search ..... 206/242, 265, 206/268, 271, 273; 229/160.1

[56] References Cited

U.S. PATENT DOCUMENTS

| | | |
|---|---|---|
| 3,708,108 | 1/1973 | Rosenburg, Jr. . |
| 4,753,383 | 6/1988 | Focke et al. . |
| 5,092,107 | 3/1992 | Lamm . |
| 5,129,513 | 7/1992 | David et al. . |
| 5,341,925 | 8/1994 | Fleenor et al. . |

FOREIGN PATENT DOCUMENTS

| | | |
|---|---|---|
| 414532 | 2/1991 | European Pat. Off. . |
| 507112 | 10/1992 | European Pat. Off. . |
| 547449 | 7/1993 | European Pat. Off. . |
| 1967145 | 5/1967 | Germany . |
| 2360701 | 6/1975 | Germany . |
| 4109702 | 9/1992 | Germany . |
| 863920 | 3/1961 | United Kingdom . |
| 9301095 | 1/1993 | WIPO . |

*Primary Examiner*—Jimmy G. Foster
*Attorney, Agent, or Firm*—Sughrue, Mion, Zinn, Macpeak & Seas, PLLC

[57] ABSTRACT

In hinge-lid packs, especially such with rounded or beveled pack edges (23, 24, 25, 26), an additional closing aid is desirable. To this end, in the upper region of a collar (35) or collar side walls (37, 38) thereof, projections (40) are formed which, in the closed position, correspond to counter projections (43) on the inside of lid side walls (19, 20).

8 Claims, 5 Drawing Sheets

Fig. 3
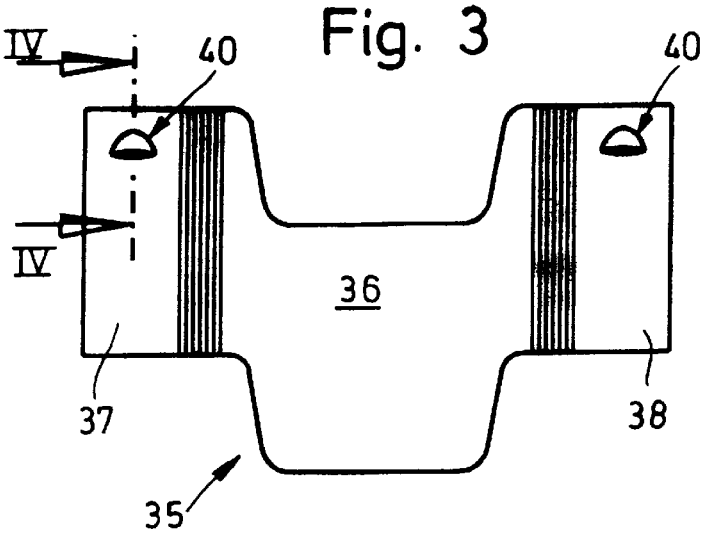
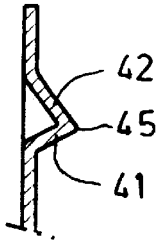
Fig. 4
Fig. 5
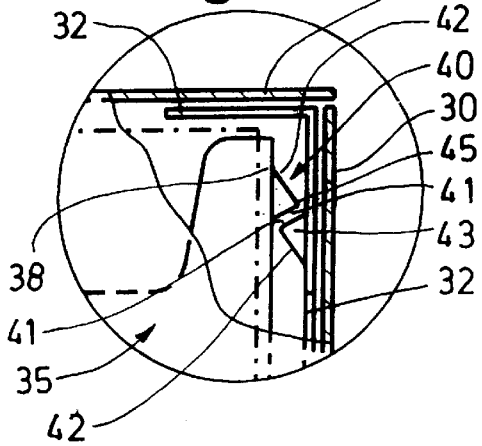
Fig. 2
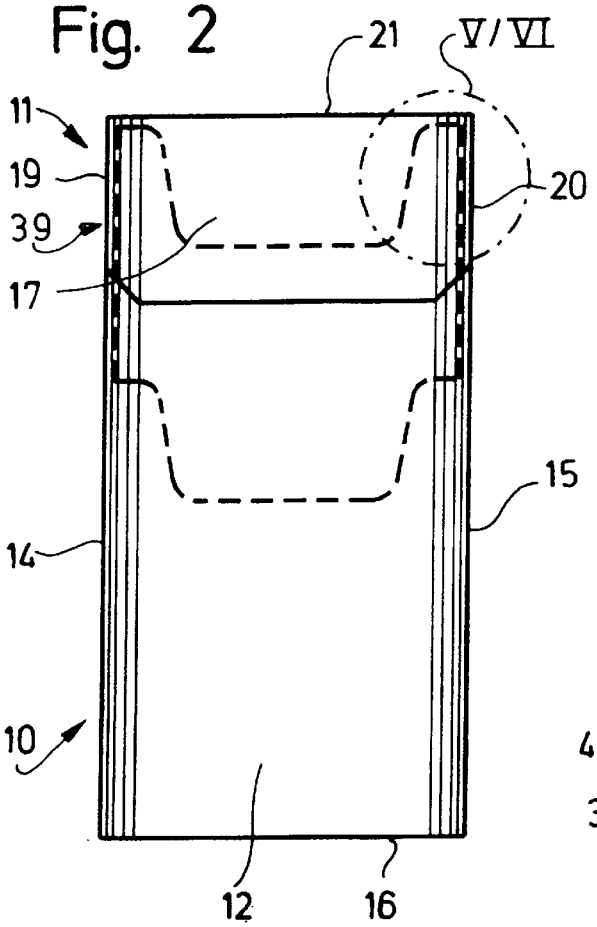
Fig. 6
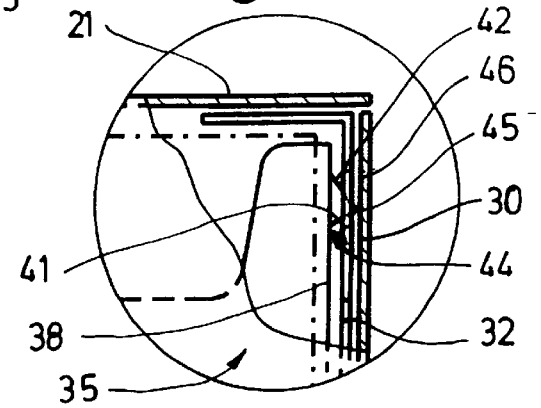

Fig 10
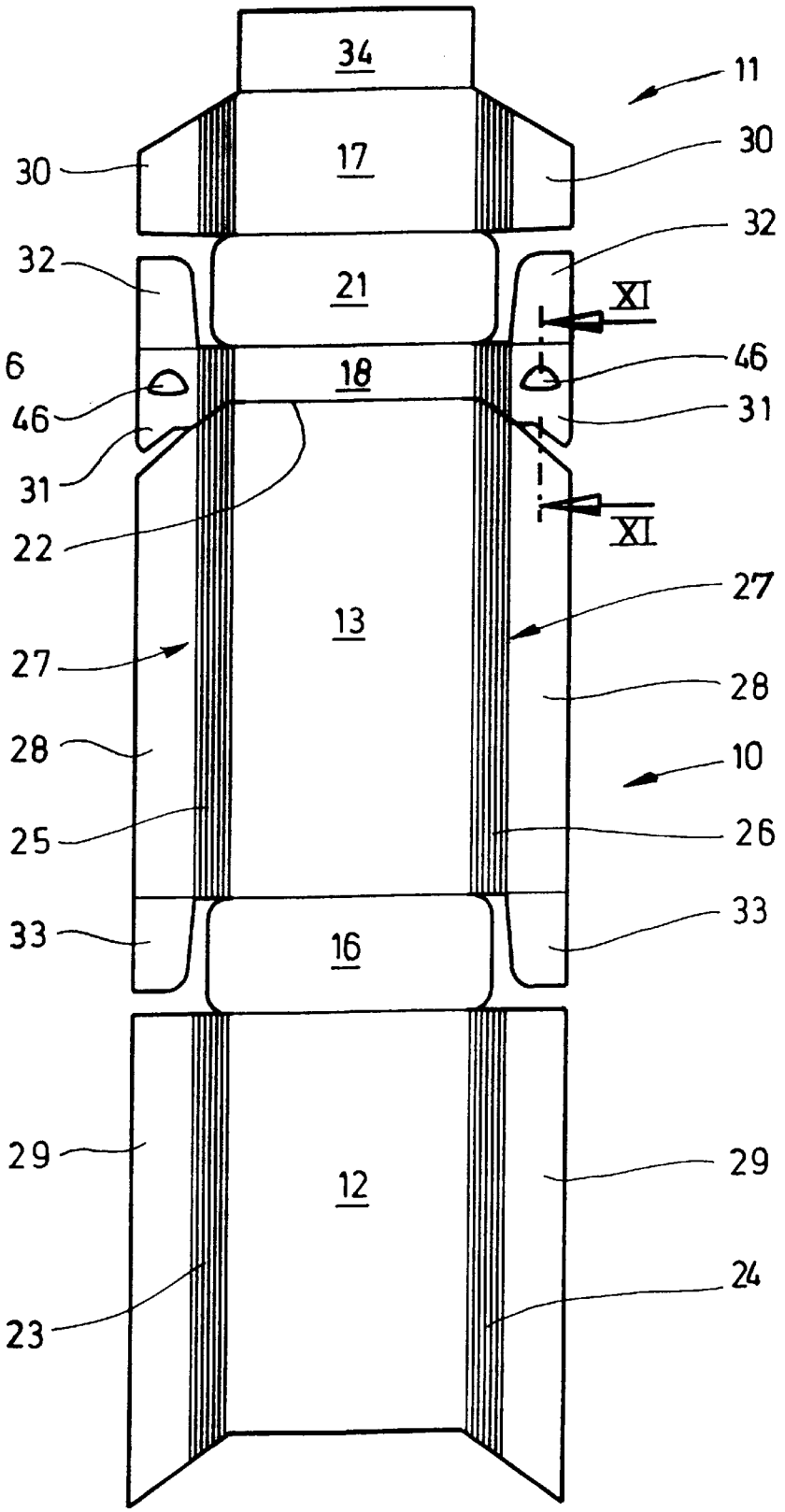
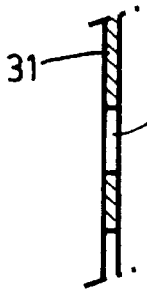
Fig. 11

HINGE-LID PACK, ESPECIALLY FOR CIGARETTES

BACKGROUND OF THE INVENTION

The invention relates to a hinge-lid pack for a cigarette group or other pack contents, comprising a pack part and a lid hingedly connected thereto, and a collar which is preferably made from a separate blank, with a collar front wall and collar side walls, the collar projecting from the pack part with a collar upper portion in the region of the pack front wall and pack side walls, such that the collar upper portion is surrounded by the lid in the closed position.

Hinge-lid packs are typical for cigarettes, but also for other articles. The standard structure provides that a formed cigarette group is surrounded by an inner blank and forms the pack contents as a cigarette block. The hinge-lid pack itself is made from thin cardboard. The lid is connected to the pack is rear wall of the pack part via an articulated line in the region of the lid rear wall. The collar is usually made from a separate blank, but may, however, also be connected to the rest of the blank in one piece. Collar front wall and collar side wall are connected to the pack part at the inner side thereof, especially by adhesive bonding. A collar upper portion projects from the pack part.

A problem of this pack type consists in holding the lid in an accurate closed position when the pack is closed. Especially in the case of hinge-lid packs with rounded vertical pack edges (round corners) and beveled edges, a closing aid is desirable.

SUMMARY OF THE INVENTION

The invention is based on the object to propose a hinge-lid which is provided with a closing aid that is easy to produce and effective in practice.

To attain this object, the hinge-lid pack according to the invention is characterized in that, on the outer side of at least one collar side wall and/or on the inner side of at least one lid side wall, projections and/or depressions are formed which, in the closed position, engage one another frictionally and/or positively, or frictionally rest against the opposite lid side wall or against a collar side wall.

Consequently, in the hinge-lid pack according to the invention, the closing aid is formed in the region of narrow side walls, specifically between collar side walls, on the one hand, and lid side wall, on the other. The closing aid consists of corresponding members which are immediate parts of the lid side wall and/or collar side wall. The members of the closing aid are exclusively formed by embossing, and thus material deformation, and/or punching. Otherwise, the blank for the hinge-lid pack has the standard contour.

Advantageous exemplary embodiments of the invention make use of the conventional structure of a hinge-lid pack, namely in which the lid side walls are configured so as to be double-layered. They consist of an outer lid side tab and an inner lid side tab. Projections formed on the collar side walls and directed towards the lid side wall rest against the inner lid side tab in the closed position, or are in engagement with corresponding projections arranged here. If only frictional connections are used, the projections rest against the respectively opposite wall of the hinge-lid pack with increased friction.

In a further advantageous embodiment of the hinge-lid pack, the one wall which is provided with a closing aid, especially the collar side wall, is provided with a projection, and the other wall with a depression or an orifice or a hole, especially the inner lid side tab. In the closed position, the projection of the collar side wall enters into the orifice or the hole in the lid side wall.

The members of the closing aid are attached during the production of the blanks for the hinge-lid pack, on the one hand, and for the collar, on the other, so that, with respect to the closing aid, finished blanks are supplied to the packaging machine. From the point of view of production engineering, it is easy to form the projections, depressions or embossings in the region of the flat blanks during the production of the same.

Further details and advantages of the invention will be explained hereinbelow with reference to the exemplary embodiments shown in the drawings. In these:

BRIEF DESCRIPTION OF THE DRAWINGS

FIG. 2 shows a front view of the hinge-lid pack according to FIG. 1, on a reduced scale, FIG. 3 shows a blank for a collar as a part of a hinge-lid pack, FIG. 4 shows a cross-section through a part of the collar according to FIG. 3 along the cutting plane IV—IV, on an enlarged scale, FIG. 5 shows a detail of the pack according to FIG. 2, partially in a vertical section, on an enlarged scale, FIG. 6 shows a representation analogous to FIG. 5 for another exemplary embodiment, FIG. 10 shows a spread-out blank for a hinge-lid pack according to FIG. 9, FIG. 11 shows a detailed section of FIG. 10 along the cutting plane XI—XI, on an enlarged scale.

DESCRIPTION OF PREFERRED EMBODIMENTS

Figure 1:
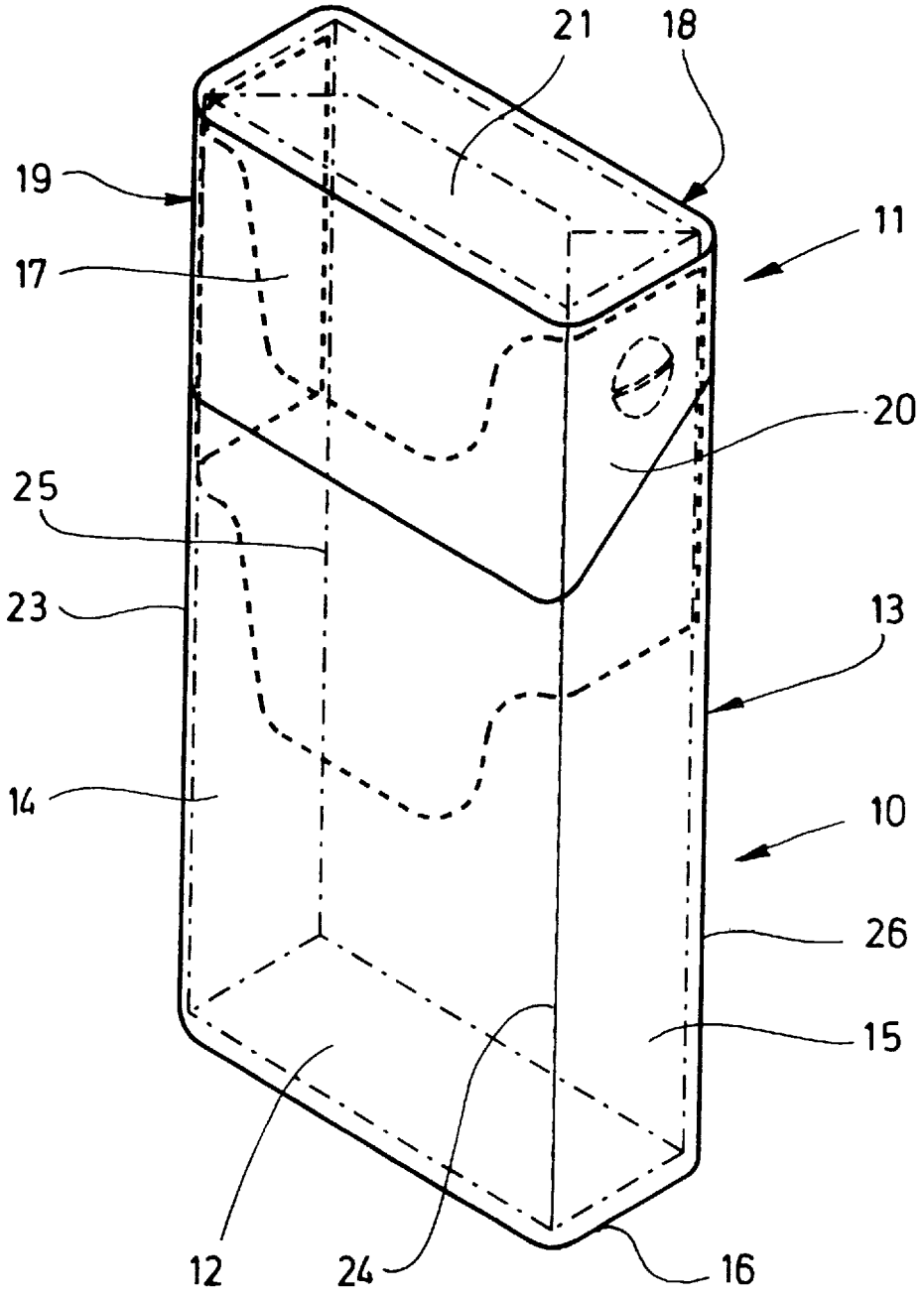
FIG. 1 shows a perspective view of a closed hinge-lid pack.

The exemplary embodiments shown in the drawings relate to the design of hinge-lid packs for cigarettes. This pack type is made from thin cardboard. A lower pack part 10 and a pivotable lid 11 are connected to one another as a unit. The pack part 10 comprises a pack front wall 12, pack rear wall 13, pack side walls 14, 15, and a bottom wall 16. Analogously, the lid comprises a lid front wall 17, lid rear wall 18, lid side walls 19, 20 and an upper end wall 21. Pack part 10 and lid 11 are connected to one another in the region of the pack rear wall 13 and the lid rear wall 18 along a transversely directed articulated line 22.

Figure 7:
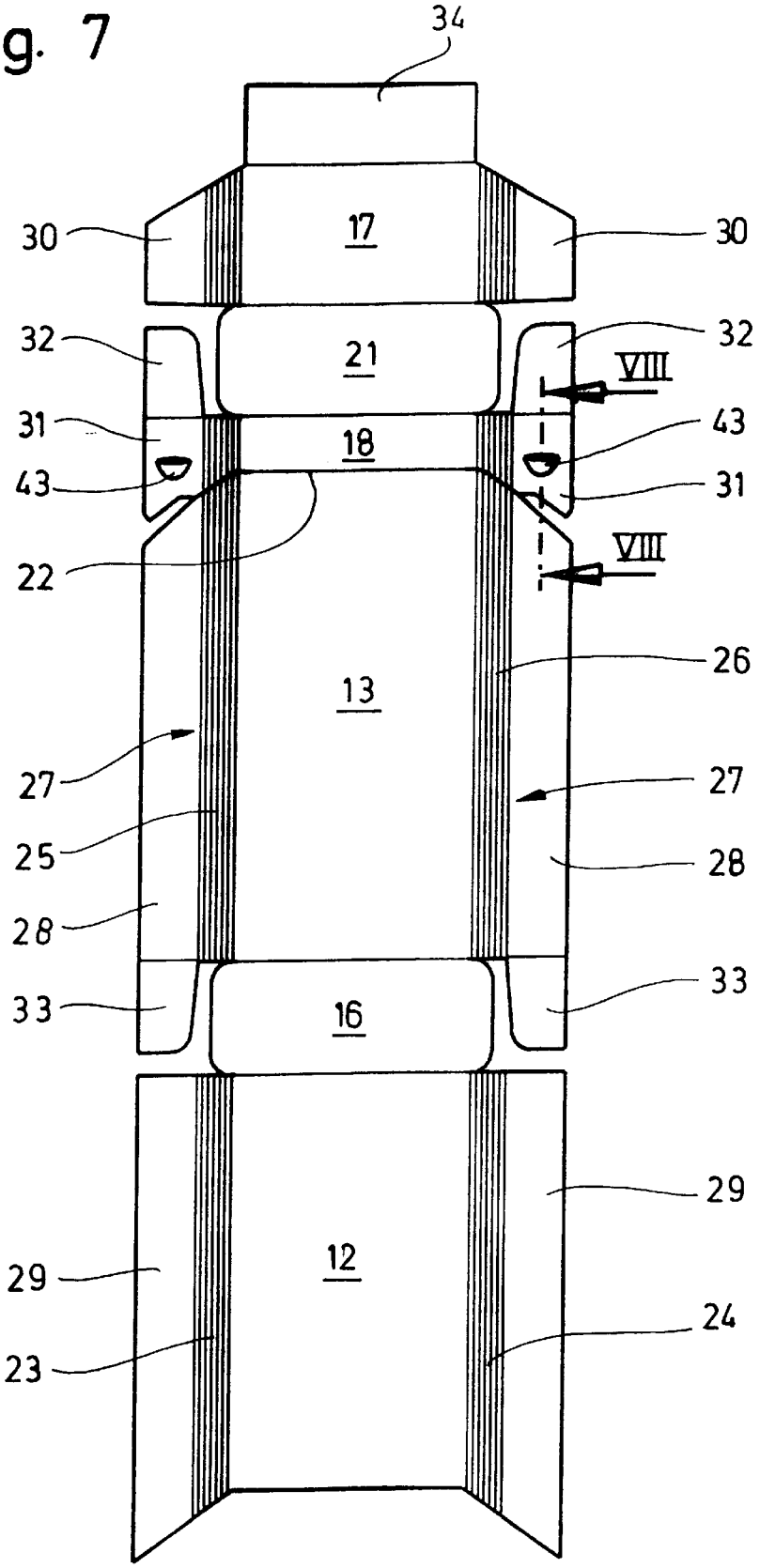
FIG. 7 shows a spread-out blank for a hinge-lid pack according to FIG. 1.

As a peculiarity of the present exemplary embodiments of the hinge-lid pack, the vertical pack edges 23, 24, 25, 26 of the pack are designed as round corners, and thus with a cross-section in the shape of approximately, a quadrant with adaptation to the dimensions of a cigarette. Bottom wall 16 and end wall 21 are rounded in the regions of corners in a corresponding manner. The pack edges 23 to 26 are formed during the folding of the blanks for the hinge-lid pack (FIG. 7, FIG. 10). To this end the blanks are provided with edge strips 27, namely pre-embossings which, in this case, take the form of narrow, parallel grooves extending in the longitudinal direction of the blank or the pack edges 23 to 26.

The pack side walls 14, 15 are configured so as to be double-layered or double-walled just as the lid side walls 19, 20. Two respective pack side strips 28, 29 or corresponding lid side strips 30, 31, which overlap one another at least in a subregion, form said side walls 19, 20 and, for this purpose, are connected to one another by adhesive bonding or the like. The inner pack side strips 28 laterally adjoin the pack rear wall 13, whereas the outer pack side strips 29 are connected to the pack front wall. The lid is designed correspondingly.

Inner lid side strips 31 are connected to lid corner tabs 32 which rest against the inside of the end wall 21 and are adhesively bonded thereto in the finished hinge-lid pack. Correspondingly, bottom corner tabs 33 are connected to the bottom wall 16.

The lid front wall 17 is adjoined by a lid inner tab 34 which, in the finished hinge-lid pack, is folded against the inside of the lid front wall 17 and connected thereto.

Furthermore, a collar 35 belongs to a hinge-lid pack. This collar 35 is made from a separate blank (FIG. 3) here. The collar 35 is comprised of a collar front wall 36 and collar side tabs 37, 38. The thus designed collar 35 is positioned in the pack part 10, such that a lower part of the collar front wall 36 rests against the inside of the pack front wall 12. The collar side walls 37, 38 rest against the inside of the pack side walls 14, 15. The collar 35 is connected to the pack part 10, for example by adhesive bonding.

The relative position of the collar 35 to the pack part 10 is chosen such that an upper part, namely a collar upper portion 39 projects from the pack part 10. The collar upper portion 39 is positioned inside the lid 11 in the closed position of the hinge-lid pack, namely in the region of lid front wall 17 and lid side wall 19, 20. The collar side walls 37, 38 thereby rest against the assigned lid side walls 19, 20.

Figure 9:
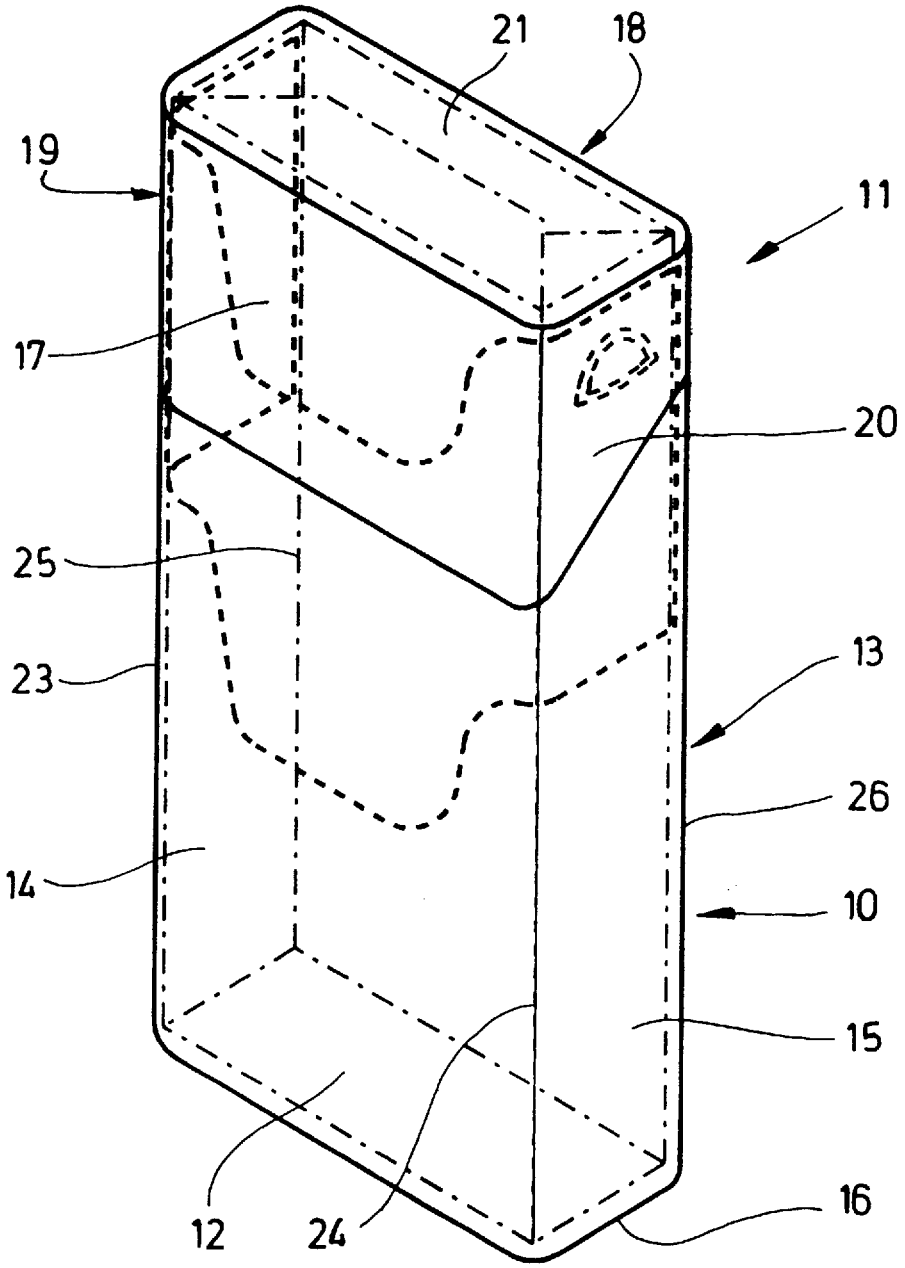
FIG. 9 shows a hinge-lid pack in a representation corresponding to FIG. 1, for another exemplary embodiment.

The present hinge-lid packs are provided with a closing aid, and thus with members which stabilize the closed position of the hinge-lid pack shown in FIG. 1, FIG. 2 and in FIG. 9 but, nevertheless, do not impede the opening and closing process.

In the present case, the closing aids consist of deformed and/or embossed part regions of walls which are present due to the structure of hinge-lid packs. In the present case, an additional closing force is exerted by the interaction of the lid side walls 19, 20, on the one hand, and the collar side walls 37, 38, on the other.

Figure 8:
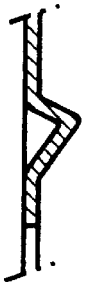
FIG. 8 shows a section through a subregion of the blank according to FIG. 7 along the cutting plane VIII—VIII, on an enlarged scale.

An embodiment of the closing aid is shown in FIG. 1 and FIG. 3 to FIG. 5, as well as FIG. 7 and FIG. 8. Walls confronting one another in the region of the lid 11, namely collar side walls 37, 38, on the one hand, and the inner lid side strips 31, on the other hand, are provided with projections which are in frictional engagement with one another when the pack is closed (FIG. 1, FIG. 5). To this end, projections 40 directed towards the lid side walls 19, 20 are arranged in the region of the collar side walls 37, 38 in an upper region, and thus inside the collar upper portion 39. These projections 40 are formed by embossing the material of the collar side walls 37, 38. The cross-section of the projections 40 is shown in FIG. 4. According to this Figure, the projections 40 have an angular cross-section with a lower obliquely directed supporting surface 41. The upwardly adjoining wall 42 of the projection 40 is arched here. Altogether, the projection 40 has an arched contour with a transversely directed bottom as supporting surface 41. The projection 40 is expediently formed during the production of the blank for the collar 35 by embossing.

On the opposite side, and thus on the inner lid side strip 31, a counter projection 43 is formed. This counter projection 43 has the same geometrical shape as the projection 40 in the present case, the supporting surface 41 being directed upwardly. The relative position of projection 40 and counter projection 43 is selected such that, in the closed position of the hinge-lid pack (FIG. 1, FIG. 5), the projections are in positive engagement with one another. This means that the supporting surfaces 41 of the two projections rest on top of one another (FIG. 5). As a result, a locking or snapping effect is achieved when closing the hinge-lid pack. When opening the lid 11, a slight resistance has to be overcome.

A modified embodiment of the closing aid is shown in FIG. 6 and FIG. 9 to FIG. 11. In this embodiment, a projection 44 is merely formed on one side, namely on the collar side walls 37, 38. This projection 44 is configured in the same manner here as the projection 40 of the described embodiments, and thus with supporting surface 41 and wall 42.

The projection 44 interacts with the inner lid side strip 31. When opening and closing the lid, the projection 44 slides along the inner side of the lid side strip 31 with an-outwardly directed friction edge 45. The result is a greater closing force in the closed position.

This effect is intensified in the present case in that the projection 44, in the closed position, snaps into position in a depression of the lid 11, namely in a hole 46 which is formed in the lid side strip 31. The hole 46 (FIG. 10. FIG. 11) is positioned, such that the snapping effect is created exactly in the closed position of the lid 11. The geometrical shape of the hole 46 corresponds to that of the projection 44, so that the latter, in the closed position of the hinge-lid pack, is fittingly, positively received in the hole 46 (FIG. 9). The snapping process during the opening and the closing of the lid 11 is thereby facilitated.

The closing aids may be modified in various respects. This especially applies to projections formed by embossing and/or punching the material of the collar 35 or the lid 11. In the simplest embodiment, one respective projection may be arranged only on the inside of the lid-side strip 31 or the collar side walls 37, 38. In this simple embodiment, the closing aid is exclusively effected by friction force. A better effect is achieved, if additionally a positive engagement with other projections or depressions or holes takes place.

We claim:

1. A hinge-lid pack for pack contents, comprising a pack part (10) and a lid (11) hingedly connected thereto, and a collar (35) having a collar front wall (36) and collar side walls (37, 38), the collar (35) projecting from the pack part (10) with a collar upper portion (39), such that a collar upper portion (39) is surrounded by the lid (11) in the closed position of the lid, characterized in that:

on the outer side of at least one collar side wall (37, 38) and on an inner side of at least one lid side wall (19, 20) are formed complementaav members (40, 43, 44, 46) which, in the closed position, are positively engaged with one another; and said complementary members are projections, and each of the projections (40, 43, 44) is formed by deforming a folding tab which is provided with the projection (40, 43, 44), such that an archedly delimited, arched wall (42) of each projection (40, 43, 44) merges into a transversely directed supporting surface (41), a friction edge (45) extending between the wall (42) and the supporting surface (41).

2. A hinge-lid pack for pack contents. comprising a pack part (10) and a lid (11) hingedly connected thereto, and a collar (35) having a collar front wall (36) and collar side walls (37, 38), the collar (35) projecting from the pack part (10) with a collar upper portion (39), such that a collar upper portion (39) is surrounded bv the lid (11) in the closed position of the lid, characterized in that:

on the outer side of at least one collar side wall (37, 38) and on an inner side of at least one lid side wall (19, 20) are formed complementary members (40, 43, 44, 46) which, in the closed position, are positively engaged with one another, and the complementary members are a projection (44) and a depression (46), respectively, wherein the projection (44), in the closed position of the lid (11), enters into the depression (46) of an opposite folding tab of the pack, such that the projection (44) on the collar side wall (37, 38) enters into the depression (46) of the lid side wall (19, 20); and in the lid (11), in which the lid side walls (19, 20) are comprised of partially mutually overlapping lid side strips (30, 31), a depression (46) produced by embossing is provided in one (31) of the inner lid side strips, into which depression (46) the projection (44) on the collar side wall (37, 38) positively enters in said closed position.

3. A hinge-lid pack for pack contents comprising a pack part (10) and a lid (11) hingedly connected thereto, and a collar (35) having a collar front wall (36) and collar side walls (37, 38), the collar (35) projecting from the pack part (10) with a collar upper portion (39), such that a collar upper portion (39) is surrounded by the lid (11) in the closed position of the lid, characterized in that:

on the outer side of at least one collar side wall (37, 38) and on an inner side of at least one lid side wall (19, 20) are formed complementary members (40, 43, 44, 46) which, in the closed position, are positively engaged with one another; and the projection (40) on a collar side wall (37, 38), in the closed position, is in engagement with the projection (43) on a lid side wall (19, 20), such that an upwardly directed supporting surface (41) formed on the projection (43) of the lid side wall (19, 20) rests against a downwardly directed supporting surface (41) of the projection (40) on the collar side wall (37, 38); and said complementary members are projections, and each of the projections (40, 43, 44) is formed by deforming a folding tab which is provided with the projection (40, 43, 44), such that an archedly delimited, arched wall (42) of each projection (40, 43, 44) merges into the supporting surface (41), a friction edge (45) extending between the wall (42) and the supporting surface (41).

4. A hinge-lid pack for pack contents, comprising:

a) a pack part (10) having a front wall (12), a rear wall (13), a side wall (14, 15) and a bottom wall (16);

b) a lid (11) having a lid front wall (17), a lid end wall (21) and lid side walls (19, 20), said lid being connected to the pack part (10) in a region of the pack rear wall (13), and being hinged for opening and closing the pack part;

c) a collar (35) which is arranged in the pack part (10), which is formed from a collar front wall (36) and collar side walls (37, 38), and which has a collar upper portion (39) projecting from the pack part (10), d) the collar upper portion (39) being surrounded by the lid (11) in a closed position of the lid, e) the lid side walls (19, 20) being configured as double-layered, and having two lid side strips (30, 31) that at least partially overlap one another, with one (30) of the lid side strips lying on the outside, and the other (31) of the lid side strips (31) lying on the inside, of each lid side wall; and f) located on the outer side of at least one of the collar side walls (37, 38), and on the inner side of an adjacent inwardly-disposed lid side strip (31), a plurality of locking members for stabilizing the closed position of the lid (11), g) said members, when the lid is in the closed position, positively engaging one another.

5. The hinge-lid pack according to claim 4, characterized in that said members are projections (40, 43, 44), and in that the projection (40) located on said one side wall (37, 38), in said closed position, engages the projection (43) located on said adjacent lid side strip (31), such that an upwardly-directed supporting surface (41), formed on the projection (43) of said adjacent lid side strip (31) abuts a downwardly directed supporting surface (41) of the projection (40) on the collar side wall (37, 38).

6. The hinge-lid pack according to claim 4, characterized in that said members are projections, and in that each of the projections (40, 43, 44) is formed by deformation of a folding tab provided with the projection (40, 43, 44), such that an arched wall (42), limited as a curve, of the projection (40, 43, 44) merges into a transversely directed supporting surface (41) with a friction edge (45) running between said arched wall (42) and said supporting surface (41).

7. The hinge-lid pack according to claim 4, characterized in that said members are projections and depressions, and in that one (44) of the projections, in the closed position of the lid (11), enters into a depression (46) of a folding tab of the pack.

8. The hinge-lid pack accrding to claim 7, characterized in that said one projection (44) is located on the collar side wall (37, 38) and enters into the depression (46), created by punching, in said adjacent inwardly-disposed lid side strip (31) and positively engages with the depression in said closed position.

* * * * *